United States Patent [19]

Linke et al.

[11] 4,072,776

[45] Feb. 7, 1978

[54] PROCESS FOR THE FLAMEPROOFING OF TEXTILE MATERIALS

[75] Inventors: Fritz Linke; Walter Dürsch, both of Konigstein, Taunus; Hans-Jerg Kleiner, Kronberg, Taunus, all of Germany

[73] Assignee: Hoechst Aktiengesellschaft, Frankfurt am Main, Germany

[21] Appl. No.: 621,502

[22] Filed: Oct. 10, 1975

[30] Foreign Application Priority Data

Oct. 19, 1974 Germany ..... 2449465

[51] Int. Cl.[2] ..... B05D 3/02

[52] U.S. Cl. ..... 427/390 D; 106/15 FP; 252/8.1; 260/30.6 R; 260/DIG. 24; 427/394; 428/272; 428/276

[58] Field of Search ..... 428/DIG. 92, 276, 272; 427/394, 390 D; 106/15 FP; 260/DIG. 24, 30.6 R; 252/8.1

[56] References Cited

U.S. PATENT DOCUMENTS

| | | | |
|---|---|---|---|
| 3,695,925 | 10/1972 | Weil | 428/921 |
| 3,817,779 | 6/1974 | Golborn | 428/921 |
| 3,830,769 | 8/1974 | Ray-Cahudhuri et al. | 428/921 |
| 3,854,989 | 12/1974 | Golborn | 428/921 |
| 3,855,359 | 12/1974 | Weil | 428/921 |

*Primary Examiner*—Ronald H. Smith
*Assistant Examiner*—Janyce A. Bell
*Attorney, Agent, or Firm*—Connolly and Hutz

[57] ABSTRACT

A process for the flameproofing of fiber material, which comprises applying (meth-)acrylic acid-alkyl-esters of the general formula

I, in which $n$ and $m$ are 0 or 1 and $(n+m)$ are 0 or 1, and $R_1$ stands for a saturated or unsaturated aliphatic hydrocarbon radical having from 1 to 8, preferably from 1 to 4 carbon atoms, which radical may also be substituted, preferably mono-substituted, by chlorine, bromine, the nitrile group, or the radicals $—OR_4$ or $—COOR_4$, $R_2$ has the same meaning as $R_1$ and — for $n = 0$ and $m = 1$ — may also be a group of the formula Ia or Ib, Z, $Z^1$, $Z^2$ represent straight-chain or branched $(C_1-C_3)$-alkylene radicals which may also be substituted, preferably mono-substituted, by chlorine, bromine or the hydroxy group, X stands for a hydrogen, a chlorine or a bromine atom, a hydroxy or a methyl group, $R_3$ represents a hydrogen atom or a methyl group, and $R_4$ is a hydrogen atom or an alkyl group having from 1 to 8 carbon atoms, and $R_5$ is a hydrogen atom, the methyl or the chloromethyl group, onto the fiber material, the said (meth-)acrylic acid-alkyl-esters being dissolved in an inert solvent, and subjecting the latter substances to a polymerization by using radicals.

6 Claims, No Drawings

PROCESS FOR THE FLAMEPROOFING OF TEXTILE MATERIALS

The present invention relates to a process for the flameproofing of textile materials.

The use of acrylamide derivatives polymerizable by radicals and containing phosphonic acid ester groups, as well as of polyfunctional vinyl-phosphonic acid-esters and phosphonic acid-allyl-esters for the flameproofing of fiber material has already been known (cf. German Offenlegungsschriften Nos. 2,118,224, 2,215,434, 2,217,746, 2,228,358, 2,228,698, 2,144,482). The use of phosphinic acid-allyl-esters (German Offenlegungsschrift No. 2,144,482) and of acrylamide derivatives containing phosphinic acid ester groups (German Offenlegungsschrift No. 2,218,224) has also been described. However, the polymerization tendency of the polyfunctional phosphonic and/or phosphinic acid-allyl-esters (German Offenlegungsschrift No. 2,144,482) and of the vinyl-phosphonic acid esters (German Offenlegungsschriften Nos. 2,228,358, 2,228,698) is relatively low, so that due to the inhibition of atmospheric oxygen of the polymerization by radicals an addition of fairly large amounts of better polymerizing cross-linking monomers, such as, above all, of N-methylolacrylamide, is required. The acrylamide derivatives which contain phosphonic and/or phosphinic acid ester groups and which have been described in the German Offenlegungsschrift No. 2,118,224, have the drawback that they are solid at room temperature, thus causing difficulties in the preparation of the finishing baths. It is a common characteristic of all the products on the basis of phosphonic acid esters that relatively large amounts are required of them for the flameproofing, in particular the flameproofing of fully synthetic fiber material.

The present invention provides a process for the flameproofing of fiber material, which comprises applying (meth-)acrylic acid-alkyl-esters of the general formula

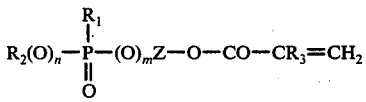

I, in which $n$ and $m$ are 0 or 1 and $(n+m)$ are 0 or 1, and $R_1$ stands for a saturated or unsaturated aliphatic hydrocarbon radical having from 1 to 8, preferably from 1 to 4 carbon atoms, which radical may also be substituted, preferably mono-substituted, by chlorine, bromine, the nitrile group or the radicals $—OR_4$ or $—COOR_4$, $R_2$ has the same meaning as $R_1$ and —for $n = 0$ and $m = 1$ — may also be a radical of the formula

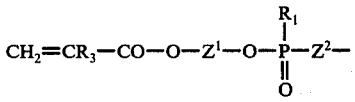

Ia or

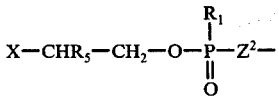

Ib,

Z, $Z^1$, $Z^2$ represent straight-chain or branched $(C_1—C_3)$-alkylene radicals which may also be substituted, preferably mono-substituted, by chlorine, bromine or the hydroxy group, X stands for a hydrogen, a chlorine, or a bromine atom, a hydroxy or a methyl group, $R_3$ represents a hydrogen atom or a methyl group, and $R_4$ is a hydrogen atom or an alkyl group having from 1 to 8 carbon atoms, and $R_5$ is a hydrogen atom, the methyl or the chloromethyl group, onto the fiber material, the said (meth-)acrylic acid-alkyl-esters being dissolved in an inert solvent, and subjecting the latter substances to a polymerization by using radicals.

Depending on the existence and the arrangement of the oxygen atom between the phosphorus atom and the radicals $R_1$, $R_2$ and Z, i.e. depending on the choice of $n$ and $m$, three different types of compound can be distinguished, which correspond to the general formula I, namely

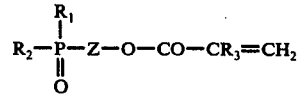

A

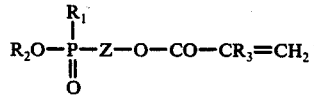

B and

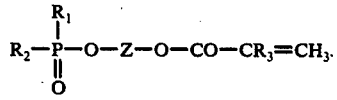

C

For carrying out the process of the invention, the following acrylic acid esters ($R_3$ = H) and/or methacrylic acid esters ($R_3$ = $CH_3$) may be used, for example: of type A:

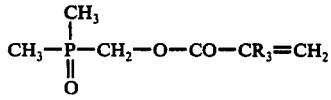

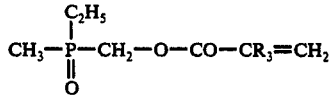

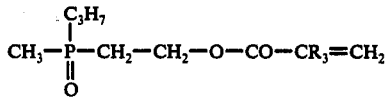

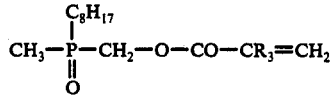

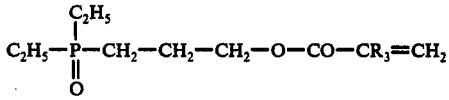

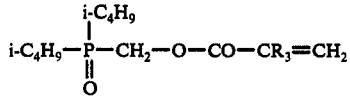

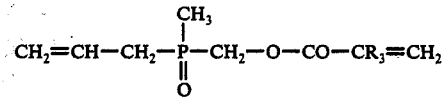

-continued
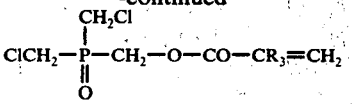
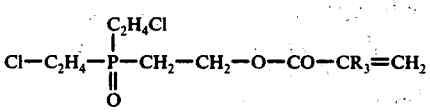
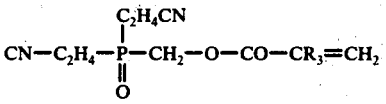
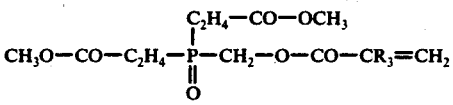
of type B:
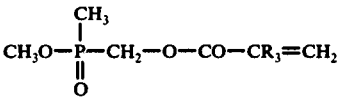
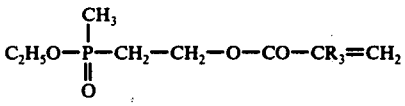
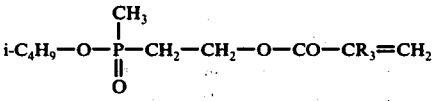
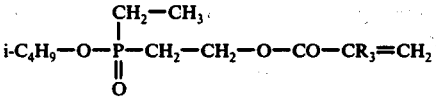
-continued
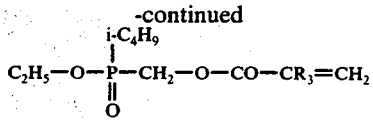
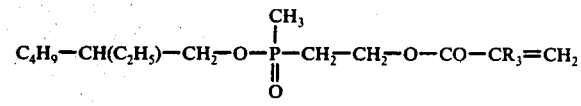
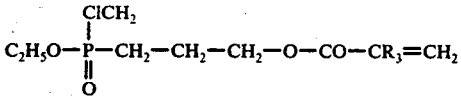
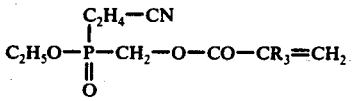
of type C:
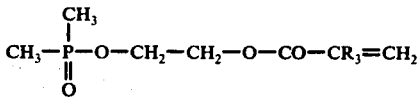
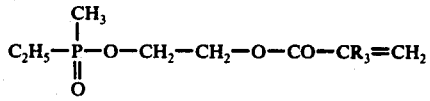
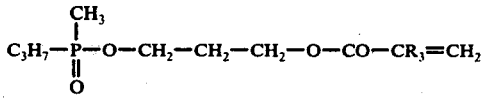
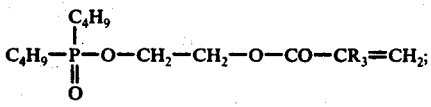
the pure forms or the mixtures of the isomers of the following compounds:
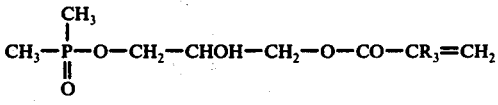
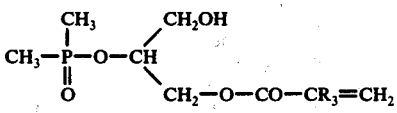
and/or
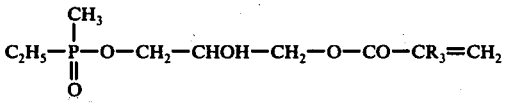
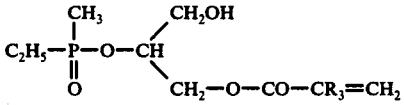
and/or
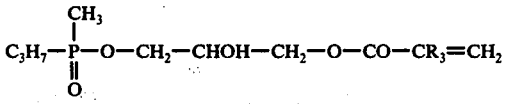
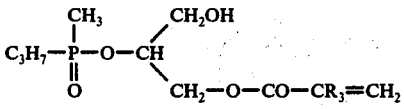
and/or -continued
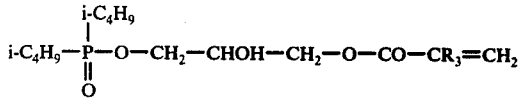
and/or
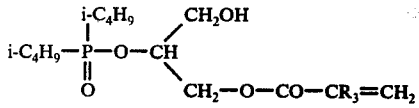
and/or
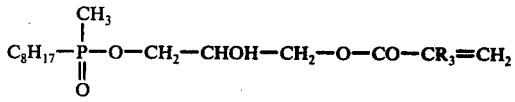
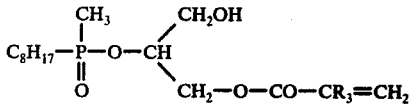
and/or
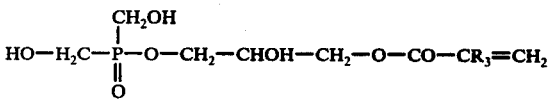
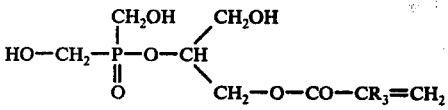
and/or
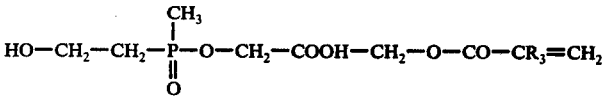
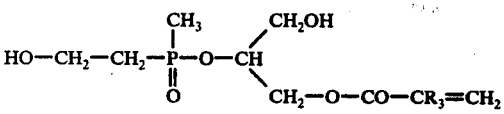
and/or
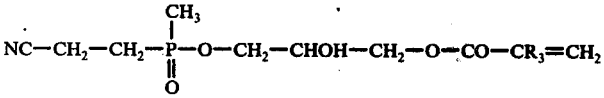
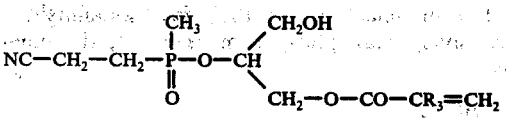
and/or
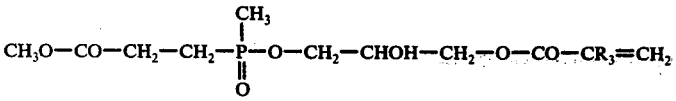
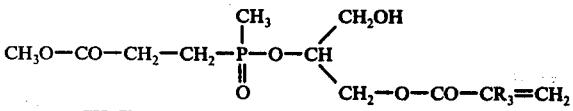
and/or
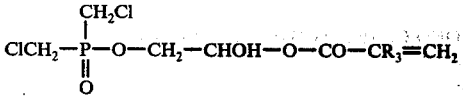
and/or
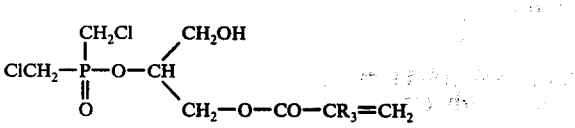
and/or
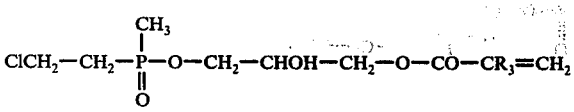

-continued
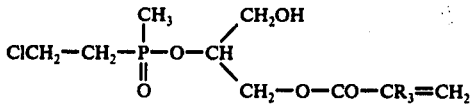
and/or
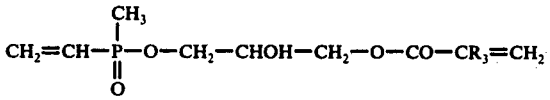
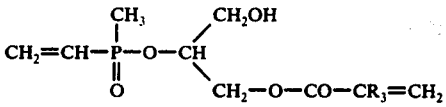
and/or
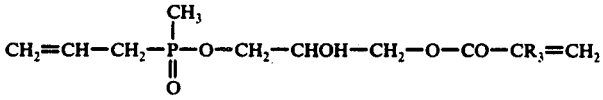
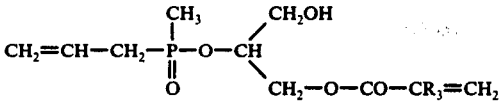
and/or
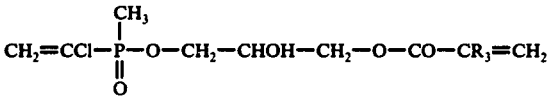
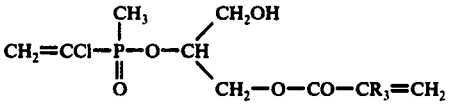
and/or
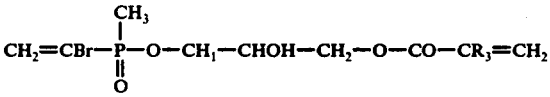
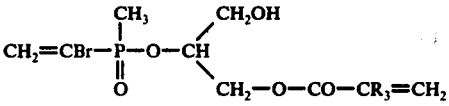
and, to the same extent, all analogous compounds in which the OH group of the phosphinic acid ester group has been replaced by Cl or Br. Besides, there may be mentioned:
Due to economical reasons, their good solubility and their relatively high phosphorous content, the compounds
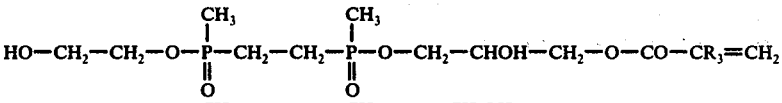
and/or
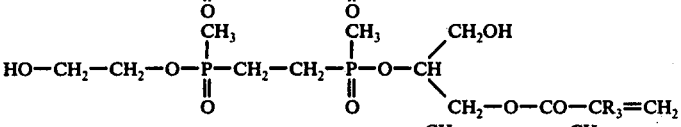
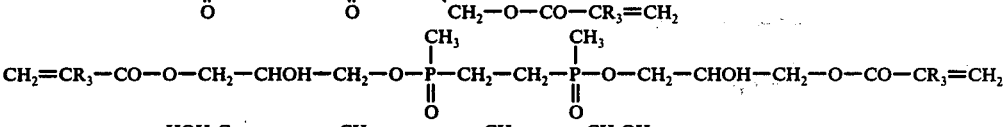
and/or
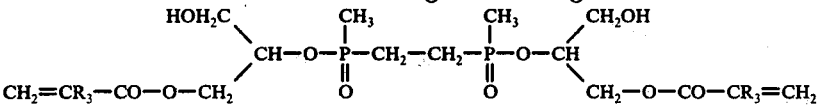
and/or
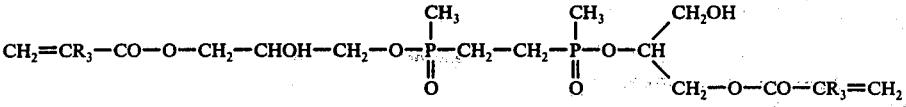

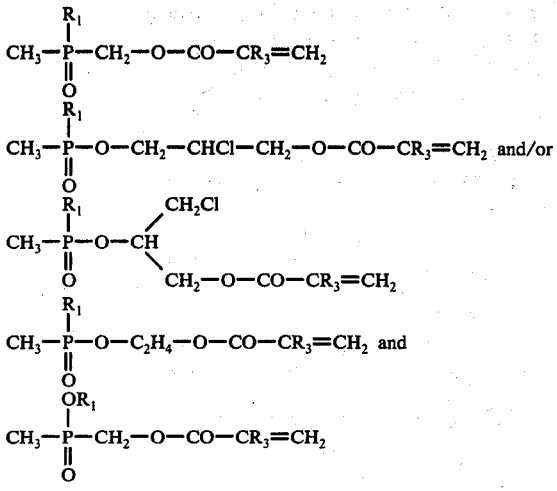

wherein $R_1$ stands for ($C_1$ - $C_3$)-alkyl, are preferably used.

The monomers of type A can be obtained by reacting the compounds of the formula

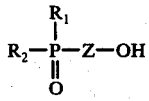

with acrylic acid- or methacrylic acid chloride (German Offenlegungsschrift No. 2,052,569), or by reacting the halides of the formula

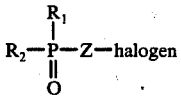

with the alkali metal salts of the acrylic or methycrylic acid (German Offenlegungsschrift No. 2,147,264).

The monomers of type B are obtained by reacting the compounds of the formula

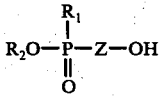

with (meth)acrylic acid chlorides or -alkyl esters. The monomers of type C can be obtained in an analogous manner by reacting phosphinic acid esters of the formula

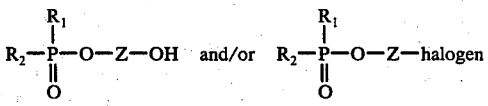

with (meth)acrylic acid chlorides and/or the alkali metal salts of the (meth)acrylic acid. The compounds of type C, in which Z represents a halogeno-alkylene or a hydroxy-alkylene group, may be obtained by reacting phosphinic acids or phosphinic acid halides with (meth-)acrylic acid-glycidyl-esters. These monomers are in most cases viscous oils which cannot be distilled.

It is possible, however, to use the high per cent crude products directly, as they are obtained in the preparation process, as has been done in the following examples of application.

The above-mentioned monomers are generally well soluble in water and can be applied onto the fiber material in an aqueous finishing bath. For monomers which are difficultly soluble in water, or which are insoluble in water, i.e. which contain for example longer alkyl radicals and/or chlorine or bromine, polar organic solvents are advantageously used for the preparation of finishing baths, for example lower alcohols, acetone, dioxane and others, and/or their mixtures with water or chlorinated hydrocarbons, or toluene.

The good polymerization capability of the acrylic acid esters of the invention makes the polymerization possible without protection by an inert gas and in the presence of atmospheric oxygen, on the textile substrates under conditions which are appropriate for textile materials, even on a large substrate surface.

The polymers thus obtained impart a good flameproof finish to many different textile fabrics. The amounts required for this purpose are generally in the range of from 100 to 500 parts by weight of monomers of the formula I, or of mixtures of such monomers, calculated on 1000 parts by weight of a textile substrate, preferably from 150 to 400 parts by weight, in particular from 200 to 350 parts by weight, calculated on 1000 parts by weight of substrate. It is also possible to use larger amounts, but this is generally of no advantage.

As polymerization catalysts, radical yielding substances are generally added to the finishing baths, however, it is also possible to produce radicals on the fiber material, for example by a treatment with rays that are rich in energy.

As polymerization catalysts, use is made of the compounds known for the polymerization of acrylates, i.e. for aqueous finising baths there are used, for example, potassium- or ammonium-peroxidisulfate (-persulfate), hydrogen peroxide or hydrogen peroxide-yielding substances, such as $NH_4P_2O_7 . H_2O_2 \cdot H_2O$ or $(NH_2CONH_2) \cdot H_2O_2$ (labelled carbamide hydrogen peroxide in the Examples), moreover, redox catalyst systems, such as hydrogen peroxide and ascorbic acid or sodium bisulfite, manganese(II) chloride or ferrous(II) chloride and sodium bisulfite, sodium chlorate/sodium bisulfite, sodium carbonate/sodium bisulfite.

For non aqueous baths, there are suitable, for example, dibenzoyl-peroxide, di-tert.-butyl-peroxide, azo-di-iso-butyronitrile, succinylperoxide, The amount of these radical-yielding substances is generally in the range of from about 0.1 to 3% by weight, preferably from 0.2 to 1.5% by weight, calculated on the monomer. In the choice and the dosage of the catalysts it is important to maintain a sufficient bath stability at room temperature, i.e. during the treatment of the textile substrate with the finishing bath.

In order to increase the permanence, particularly the fastness to washing, of the flameproof finish obtained according to the invention, it is particularly advantageous to add further comonomers to the monomers of the formula I, especially those with a cross-linking effect. Examples for these comonomers are, first of all, acrylamide, N-methylol-acrylamide, methylene-bisacrylamide, N-methylol-methylene-bisacrylamide, N,N'-dimethylol-methylene-bisacryl-amide, N-formamidomethyl-acrylamide, divinylbenzenes, triallylcyanuric acid esters, imides and anhydrides of acrylic acid and methacrylic acid, 1,3,5-trisacryloyl-hexahydro-1,3,5-triazine.

If comonomers containing -C=C-groups are used, which have also further reactive groups, for example, acrylamide or N-methylol-containing compounds, such as N-methylol-methylene-bisacrylamide, N,N'-dimethylol-methylene-bisacrylamide, further and/or additional cross-linking components may be added to the system, for example, derivatives of amino-1,3,5-triazines, such as trimethylol-melamine, hexamethylol-melamine, hexamethylol-melamine-pentamethylether, besides derivatives of urea, such as dimethylolurea, dimethylolurea-dimethylether, di-dimethylol-cyclo-ethylene-urea, dimethylol-cyclo-propylene-urea, dimethylol-carbamates, for example, dimethylol-methyl-carbamate, dimethylol-ethyl-carbamate, etc.

These additives to the monomers of the formula I are in a range of from 10 to 300 parts by weight altogether, preferably from 30 to 180 parts by weight, in particular from 40 to 120 parts by weight, calculated on 1000 parts by weight of substrate.

As cross-linking catalysts of N-methylol compounds, there are mentioned the inorganic or organic acids that are common in the high grade finish, or the salts thereof, which set free an acid by way of hydrolysis or in the course of a heat treatment, for example, sulfuric acid, hydrochloric acid, phosphoric acid, oxalic acid, glycolic acid, lactic acid, monochloroacetic acid, trichloroacetic acid, maleic acid, tartaric acid, citric acid, acetic acid, formic acid, or the salts thereof with ammonia, amines or with oxides or hydroxides of polyvalent metals or 1-hydroxy-2-methylpropyl-ammonium-2-chloride, etc.

If ammonium- or potassium persulfate is used as radical yielding substance, it is generally not necessary to add further catalysts.

As textile fiber material there are mentioned fibers and/or textile fabrics on the basis of native or regenerated cellulose, of fully synthetic fibers or mixtures thereof. As fully synthetic or mixed fiber material, there are suitable, in particular, non-woven fabrics, such as needle felts for wall and floor coverings, for example, needle felts consisting of 100% polyamide-6 fibers, of polyester/polyamide-6 fibers in a 50/50 ratio, or those felts which have a polyester core (bottom side) and a top side (walking surface) of polyamide-6 fibers, of polyamide fibers and viscose staple fibers in a 50/50 ratio, of polyester fibers and viscose staple fibers in a 50/50 ratio, and of 100% polyester fibers.

It was a surprising fact which could not have been foreseen that good permanent flameproof effects could be obtained also on fiber material consisting of 100% polypropylene fibers, or on a mixed fiber material of polypropylene fibers with, for example, polyester or polyamide or cellulose fibers.

By non-woven fabrics, there are also to be understood those fiber fleeces which are bound by binding agents, as they are used for damming and insulation purposes (for example also as a lining) and for wet and dry filters. In this case, too, all fibers or fiber mixtures mentioned above are suitable as the textile material to be subjected to the process of the invention.

The process of the invention for the flameproofing of textile materials is effected under those application conditions as they are common in the textile industry.

The fabrics and/or needle felts are treated with the aqueous finishing baths on a two-roll or three-roll padding mangle, are then squeezed off and are subjected to a drying and/or a condensation process.

The fleeces bound by binding agents are either provided with the flameproof finish on a padder, or are hardened by being rinsed or foamed with the binding mixture.

The polymerization process using radicals is effected during the drying and/or condensation process at a temperature of more than about 80° C to about 180° C, preferably from about 100° C to 130° C. If further synthetic resin pre-condensation products are added for the cross-linking process, it is suitable to increase the drying temperature to 140° - 150° C. This is possible, most of all, in the case of polyamide and/or polyester fibers or mixtures. Textile material on the basis of polypropylene fibers or of polypropylene mixed fibers is dried preferably at a temperature of from 120° to 140° C.

It is also possible to carry out a two-step process. This process may optionally be chosen, if besides the cross-linking process by way of radicals an additional cross-linking is to be effected by means of hardening synthetic resin precondensation products.

The heat treatment lasts for 5 to about 60 minutes on an average, preferably from 10 to 30 minutes. The action of heat is produced in drying chambers, on stenter frames, hot flues and/or condensing stenters or perforated drum driers.

Further agents may be added to the finishing baths, such as textile softeners, products imparting water-repellent properties, products imparting oil-repellent properties, antistatic agents, or antimicrobial finishing agents.

According to the process of the invention, a surprisingly elastic and only slightly filling flameproof finish is generally obtained also on very closely textured needle felts. This finish is very suitable, for example, for textile flameproof wall coverings or coverings on the basis of fully synthetic fibers.

In order to improve the feel, to ensure a good retention of shape, to improve the fastness to rubbing and crushing of needle felt covering material, high polymer plastics may be added to the finishing baths, for example on the basis of polyvinyl acetate, polyvinyl acetate with plasticizers, such as dibutylnaphthalate, copolymers of vinyl acetate with maleic acid-dibutylester, copolymers of acrylic acid-butylester with N-methylolacrylamide, copolymers of acrylic acid-butylester, N-methylolacrylamide and acrylic acid, copolymers of acrylic acid-butylester, N-methylolacrylamide and N-methylol-methacrylamide, copolymers of acrylic acid butylester, methacrylic acid-methylester and methylol-methacrylamide, copolymers of acrylic acid-butylester, acrylonitrile, N-methylolacrylamide and methacrylic acid, copolymers of acrylic acid-butylester, styrene, acrylonitrile and N-methylol-methacrylamide, N-methylol-methacrylamide and butanediol-diacrylate, copolymers of acrylic acid-methylester and acrylic acid-butylester, copolymers of ethylacrylate, acrylonitrile and N-methylolacrylamide, copolymers of butylacrylate, vinyl acetate with N-methylolamide, copolymers of butylacrylate, acrylonitrile and methylolacrylamide, copolymers of styrene, butylacrylate and acrylic acid, natural latex or synthetic latices of styrene with butadiene.

The phosphorus organic compounds described according to the invention for the textile flameproofing finish have technological advantages as compared with the commercial flameproofing agent on the basis of 3-(dimethyl-phosphonic)-propionamide and also as compared against those compounds which contain the phosphoric and/or phosphonic acid-ester- and (meth-)acrylic acid-ester groups in the molecule, and compared with the phosphorus organic compounds containing carbamate- (German Offenlegungsschrift No. 2,249,321), amide- (German Offenlegungsschrift No. 2,253,663) and (meth-)allyl groups (German Offenlegungsschrift No. 2,144,482); the technological advantages being the following:

1. flameproof permanent properties on polypropylene and/or polypropylene mixed fiber material;
2. a softer feel and a higher elasticity on fully synthetic fiber or mixed fiber material;
3. an increased capability of being reeled off of the needle felts, even of those which are very closely textured. The following Examples serve to illustrate the invention.

APPLICATION EXAMPLES

EXAMPLE 1

A needle felt consisting of a fiber mixture of 50% of polyamide-6 and 50% of polyester fibers having a weight per square meter of 1100 g, which is used as floor covering in living quarters, was treated on a two-roll padding mangle with an aqueous impregnation solution having the following composition:

300 g/l dimethylphosphinyl-methyl-methacrylate of the formula $$(CH_3)_2P(O)CH_2O-CO-\underset{\underset{CH_3}{|}}{C}=CH_2,$$

80 g/l of a 50% aqueous solution of N,N'-dimethylol-methylene-bisacrylamide,
5 g/l of potassium persulfate and
200 g/l of a 40% aqueous plastic dispersion of a copolymer of ethylacrylate/acrylo nitrile/N-methylol-acrylamide in a ratio of 6 : 3 : 1.

The squeezing-off effect was 100%. Subsequently the material was dried for 20 minutes at 145° C.

The needle felt showed a very good permanent flameproof effect which lasted for several washings at 50° C and several shampooings.

The flameproofing test was effected according to DIN 54333 (= German Industrial Standard) (determination of the flame spreading rate of textile materials). A test sample which had been finished only with 200 g/l of the above-mentioned 40% plastic dispersion continued to burn, after the flame source had been removed, and the flame covered a measuring distance of 10 cm with a burning rate of 3 minutes and 20 seconds. In contradistinction thereto, the sample finished with the flameproof agent die not continue to burn after removing the flame source. After 5 shampooings a period of after-burning of 25 seconds was detected, and after this time the flame had gone out.

The needle felt thus finished showed a very good retention of shape and a improved fastness to rubbing, as compared against a needle felt which had only been finished with the plastic dispersion. The elasticity of the needle felt was very good, and after having been deformed (by rolling up) it went back to its initial state surprisingly fast. The elasticity of a needle felt thus finished with a flameproof agent is the pre-requisite for a fast laying, for example on a plaster floor.

EXAMPLE 2

A needle felt on the basis of 100% polypropylene fibers having a weight of 1000 g per square meter was impregnated on a two-roll padding mangle with an aqueous impregnation solution containing 350 g/l of dimethylphosphinyl-methyl-methacrylate,
90 g/l of a 50% aqueous solution of N,N'-dimethylol-methylene-bisacrylamide,
5 g/l of potassium persulfate, and
200 g/l of the 40% plastic dispersion of Example (1).

The squeezing-off effect was 105%. The drying was carried out for 25 minutes at 130° C.

The needle felt on the basis of polypropylene fibers thus finished had a surprisingly good flameproof quality, the flameproof effect lasted for several washings at a temperature of from 40° to 50° C and several shampooings.

The feel was very elastic and was not hardened. The needle felt showed a very good retention of shape and could be easily rolled up.

The flameproofing test was effected according to the US Motor Vehicle Safety Standard No. 302 (US-MVSS 302). A test sample which had been finished only with 200 g/l of the 40% plastic dispersion mentioned in the Example continued to burn — after removal of the flame source — with a very strong flame front, and the flame covered a measuring distance of 10 cm with a burning rate of 2 minutes and 10 seconds.

In contradistinction thereto, the test sample finished with the flameproof agent did not go on burning after removal of the flame source, but only showed an after-burn effect of 10 seconds. After 6 shampooings a period of after-buring of 15 seconds was detected, and after this time the flame had gone out.

EXAMPLE 3

A needle felt which consisted of 100% polyamide-6 fibers, which had a weight of about 650 g per square meter and which was used as a textile wall covering, was treated on a two-roll padding mangle with an aqueous impregnation solution containing 370 g/l of dimethylphosphinyl-methyl-methacrylate,
40 g/l of acrylamide,
50 g/l of hexamethylol-melamine-pentamethylether,
25 g/l of carbamide-hydrogen-peroxide, and
2 g/l of potassium persulfate.

The squeezing-off effect was about 105%. Subsequently the material was dried for 25 minutes at 140° C.

The needle felt showed a very good flameproof effect. The feel of the needle felt thus impregnated was elastic, but was nevertheless soft enough to be pasted on a wall as a textile wall covering.

The flameproofing test was effected according to DIN 54332, the test sample being pasted on a wooden plate. After the test flame had been removed, the needle felt did not burn any longer.

EXAMPLE 4

A needle felt having a weight of 980 g per square meter and consisting of polyamide-6 and polypropylene fibers in a proportion of 50 : 50 was treated on a two-roll padding mangle with an aqueous impregnation solution containing 350 g/l of dimethylphosphinyl-methyl-methacrylate,
80 g/l of a 50% aqueous solution of N,N'-dimethylol-methylene-bisacrylamide,
6 g/l of potassium persulfate, and 200 g/l of a 50% aqueous plastic dispersion of a copolymer of butylacrylate/acrylonitrile and N-methylol-acrylamide (50 : 25 : 25).

The squeezing-off effect was 95 %. The drying was effected for 25 minutes at a temperature in the range of from 138° to 140° C.

The needle felt showed a good permanent flameproof effect. The flameproofing test was carried out according to the US Motor Vehicle Safety Standard No. 302:

| | |
|---|---|
| Initial effect: | no after-burn |
| 1 washing at a moderate temperature: | no after-burn |
| 3 washings at a moderate temperature: | after-burn of 20 seconds, but the flame did not spread |
| 3 shampooings: | after-burn of 25 seconds. |

The feel was slightly fuller and elastic. The needle felt could be easily rolled up and reeled off.

EXAMPLE 5

A needle felt floor covering consisting of 100% polypropylene fibers having a weight of 1050 g per square meter was treated on a two-roll padding mangle with an aqueous impregnation bath containing 380 g/l of the compound of the formula

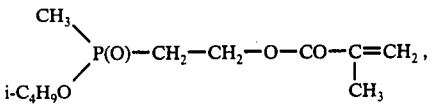

90 g/l of a 50% aqueous solution of N,N'-dimethylol-methylene-bisacrylamide, 5 g/l of potassium persulfate, 150 g/l of a plastic disperson as has been described in Example (1).

The squeezing-off effect was 100%. The drying was effected for 20 minutes at 135° C.

The needle felt thus impregnated showed a very good retention of shape and an improved fastness to rubbing, as compared against a needle felt which had been impregnated only with the plastic dispersion. It could be reeled off very well.

The flameproof effect on the polypropylene needle felt was suprisingly good. It lasted for several washings at a temperature of 50° C and several shampooings.

The flameproofing test was effected according to DIN 54332 (Determination of the rate of flame spreading for textile materials, which is a very good approach to the US Motor Vehicle Safety Standard No. 302 (US-MVSS 302)). After removal of the flame source, the needle felt did not burn any longer. After 5 shampooings, an after-burn effect of 10 seconds was detected. Then the flame went out.

Similar results were obtained, when instead of the above-mentioned phosphorus organic compound the compound of the formula

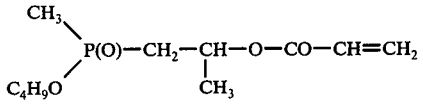

was used.

EXAMPLE 6

An aqueous impregnation solution contained the following components:

310 g/l of

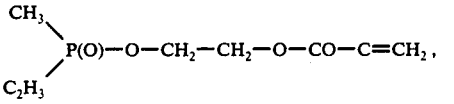

80 g/l of a 50% aqueous solution of N,N'-dimethylol-methylene-bisacrylamide, 5 g/l of ammonium persulfate, and 200 g/l of a plastic dispersion as has been described in Example (4).

This impregnation solution was used to treat 1. a needle felt consisting of 100 % polypropylene fibers, 2. a needle felt whose upper surface consisted of polyamide-6 fibers and which contained a basic fabric of 100% polyester fibers.

Both needle felts were impregnated on a two-roll padding mangle and were squeezed off to a liquor pick-up of 95 and/or 105%.

The drying was effected for 25 minutes at 135° C.

Both needle felts showed a good permanent flameproof effect which lasted for several shampooings, according to the Safety Standard No. 302 (US-MVSS 302).

Initial effect: After removal of the flame source, the two needle felts did not continue to burn, and the flame went out immediately.

After 3 shampooings, the polypropylene needle felt continued to burn for 30 seconds, whereas the after-burn period in the case of the polyamide-6-polyester needle felt was 15 seconds.

Both needle felts showed a very good retention of shape. The polypropylene needle felt was slightly filled and could easily be reeled off, whereas the polyamide-6-polyester needle felt was somewhat fuller, but it could still be reeled off easily.

EXAMPLE 7

A needle felt floor covering whose upper surface consisted of polyamide-6 fibers and whose bottom side was also composed of polyamide-6 fibers and a glass fiber grid fabric was treated on a two-rool padding mangle with an aqueous impregnation bath containing 400 g/l of the compound of the formula

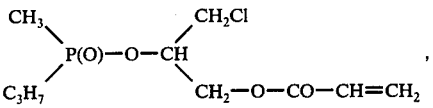

90 g/l of a 50% aqueous solution of N,N'-dimethylol-methylene-bisacrylamide, 40 g/l of hexamethylol-melamine-pentamethylether, 50 g/l of carbamide-hydrogen-peroxide, 4 g/l of ammonium chloride, and 200 g/l of the 40% plastic dispersion of Example (1).

The squeezing-off effect was 105%. The drying was effected for 25 minutes at 150° C.

The needle felt showed a good flameproof effect. The flameproofing test was again effected according to the US Motor Vehicle Safety Standard No. 302.

For the purpose of comparison, a test sample was considered which had not been finished with a flameproofing agent, but only with 200 g/l of the plastic dispersion. Its rate of flame spreading was 3 minutes and 50 seconds for a measuring distance of 10 cm.

After removal of the test flame the needle felt did not continue to burn, and no after-burn effect could be detected within the burned zone. After 3 shampooings the good flameproof quality was still maintained. The after-burn effect was 15 seconds.

EXAMPLE 8

The needle felt described in Example (7) was finished—according to said Example—with an aqueous impregnation bath which contained 400 g/l of

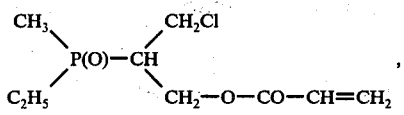

and, for the rest, the same amounts of comonomers, catalysts, hexamethylol-melamine-pentamethylether and plastic dispersion.

The drying as well as the testing processes were the same as in Example (7).

The needle felt thus impregnated showed a good permanent flameproof effect.

Initial effect: After removal of the flame source the flame went out immediately. After 3 shampooings there was an after-burn of the test sample which lasted for 35 seconds.

The needle felt showed a very good retention of shape and could be reeled off well.

EXAMPLE 9

A needle felt on the basis of polyester/polyamide (50 : 50) having a weight of 900 g per square meter was treated on a two-roll padding mangle with an aqueous finishing bath containing 350 g/l of

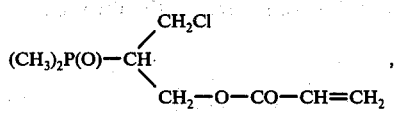

70 g/l of an aqueous 50% solution of N,N'-dimethylol-methylene-bisacrylamide, and 10 g/l of potassium persulfate, and was then squeezed off, the squeezing-off effect being about 105%. Subsequently the material was dried for 20 minutes at 145° C.

The needle felt thus treated showed a good permanent flameproof effect and was suitable as a wall covering.

The flameproofing test was effected according to DIN 54332, in which process the test sample was pasted on a wooden plate. After the flame source had been removed, the flame went out immediately. Another test sample which had been washed at 10° C with 2 g/l of a commercial detergent for washing at a moderate temperature showed—when subjected to a flameproofing test—an after-burn effect of 3 seconds after the flame source had been removed.

The flameproof needle felt was slightly filled, but could be reeled off very well and was suitable as a wall covering.

EXAMPLE 10

An aqueous impregnation solution containing the following components:

350 g/l of an about 50 : 50 isomer mixture of the compounds of the formulae

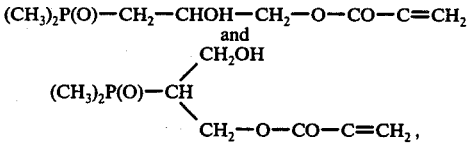

60 g/l of an aqueous 50% solution of N,N'-dimethylol-methylene-bisacrylamide, 30 g/l of hexamethylol-melamine-pentamethylether, 50 g/l of carbamide-hydrogen-peroxide, 3.5 g/l of ammonium chloride, and 200 g/l of a 40% plastic dispersion of a copolymer on the basis of butylacrylate/vinylacetate/N-methylol-acrylamide (35 : 55 : 10), was used for the impregnation of a needle felt having a weight of 980 g per square meter consisting of polyamide-6/polypropylene fibers 75/25. The squeezing-off effect was about 98%. The drying was effected for 20 minutes at 140° C.

The needle felt thus treated showed a very good retention of shape and could be easily reeled off. The flameproof effect was still very well maintained and remained permanent even after 3 washings at 50° C and 5 shampooings.

EXAMPLE 11

A needle felt consisting of a mixed fiber fleece on the basis of polyamide-6 and polyester fibers in a ratio of 75 : 25 with a weight of 900 g per square meter and containing a glass fiber grid fabric to increase the dimensional stability was finished with a flameproof agent that was fast to shampooing, thus being suitable as a covering of the passenger rooms of motor vehicles and as a covering of the trunk compartment.

The aqueous impregnation solution contained the following components:

360 g/l of an about 50 : 50 isomer mixture of the compounds of the formulae

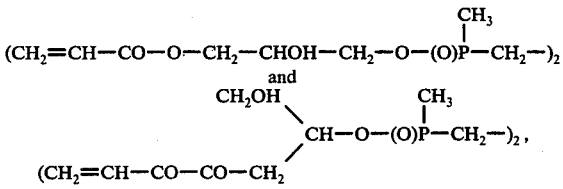

70 g/l of an aqueous solution of N,N'-dimethylol-methylene-bisacrylamide, 5 g/l of potassium persulfate, 150 g/l of a 40% plastic dispersion of a copolymer of ethyl-acrylate/acrylonitrile/N-methylol-acrylamide in a ratio of 6 : 3 : 1.

The squeezing-off effect on a two-roll padding mangle was 105%; subsequently the material was dried for 25 minutes at 145° C.

The needle felt showed a very good permanent flameproof effect which lasted for several washings at a temperature of from 40° to 50° C and several shampooings. The flameproofing test was effected according to DIN 54332 and/or according to the Motor Vehicle Safety Standard No. 302 (US-MVSS 302).

Initial effect: After removal of the flame source the needle felt did not continue to burn; the flame went out immediately.

After 3 shampooings: After removal of the test flame the needle felt did not continue to burn; it only showed an afterburn of 5 seconds.

When 5 shampooings had been carried out, the test result still remained unchanged, with the exception that the afterburn effect lasted for 10 seconds.

The same results were obtained, when a needle felt was used which consisted of a polyamide/polypropylene fiber in a ratio of 50 : 50. This needle felt, too, could be impregnated under the conditions specified above. The drying was effected at 135° C.

Initial effect: After removal of the flame source the flame went out immediately.

After 5 shampooings: The needle felt showed an after-burn of 25 seconds, but did not continue burning.

Both needle felts had a very good retention of shape and could be reeled off easily. The feel was slightly fuller.

EXAMPLE 12

A needle felt having a weight of 700 g per square meter and consisting of polyamide-6 and viscose staple fibers in a ratio of 1 : 1 was treated with the impregnation solution described in Example (11). After having been treated on the two-roll padding mangle, with a squeezing-off effect of 110%, the material was dried for 25 minutes at 140° C.

The needle felt had a very good permanent flameproof quality. The flameproofing test was effected in accordance with US-MVSS 302.

Initial effect: After removal of the test flame the needle felt did not continue to burn; the flame went out immediately.

After 3 shampooings the same result was obtained.

EXAMPLE 13

A needle felt consisting of a mixed fiber fleece on the basis of polyamide-6 and polyester fibers, such as has been described in Examples (11), was treated with an aqueous flameproofing impregnation bath containing 400 g/l of an about 50 : 50 isomer mixture of the compounds of the formulae

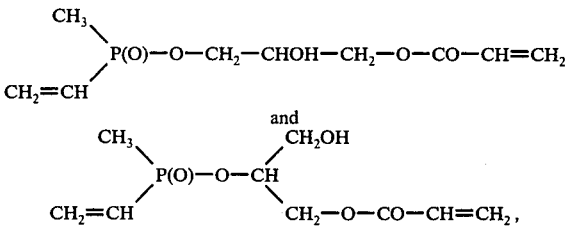

80 g/l of an aqueous 50% solution of N,N'-methylol-methylene-bisacrylamide, 2 g/l of ammonium persulfate, and 25 g/l of carbamide-hydrogen-peroxide.

The impregnation was effected on a two-roll padding mangle, and the material was dried for 25 minutes at 140° C.

As a result, a permanent flameproof effect was obtained. The needle felt covering material was slightly filled and could well be reeled off. It was suitable as a flameproof insulating material which was also rotproof.

EXAMPLE 14

A needle felt consisting of a 1 : 1 mixture of polyamide and viscose staple fibers was finished with an ethanolic impregnation solution containing 400 g/l of an about 50 : 50 isomer mixture of the compounds of the formulae

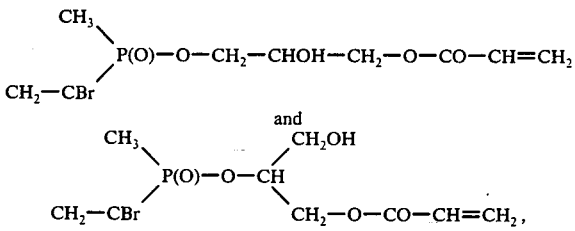

30 g/l of methylene-bisacrylamide, and 10 g/l of azo-diisobutyronitrile.

The treatment was effected on a solvent padder. The squeezing-off effect was 95%. The material was dried for 20 minutes at 128° C.

The needle felt had a good and permanent flameproof finish. The test was effected according to US-MVSS 302.

Initial effect: After removal of the test flame the needle felt did not continue to burn. The flame went out immediately.

After 3 shampooings: After removing the test flame the needle felt showed an after-burn effect of 30 seconds.

EXAMPLE 15

A needle felt consisting of 100% polyamide-6 fibers was treated with an aqueous finishing bath containing 400 g/l of the compound of the formula

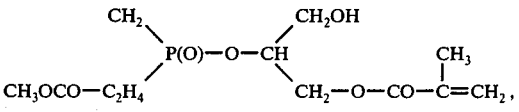

100 g/l of an aqueous 50% solution of N,N'-dimethylol-methylene-bisacrylamide, 40 g/l of hexamethylol-melamine-pentamethylether, 2 g/l of potassium persulfate, and 25 g/l of carbamide-hydrogen-peroxide.

After the padding with a squeezing-off effect of 100% the material was dried for 20 minutes at 150° C.

The needle felt was used as a flameproof air filter. The flameproofing test was effected according to DIN 54332. After removal of the test flame the needle felt did not continue to burn.

After 3 washings at 35° C using 2 g/l of a commercial detergent for washing at moderate temperatures, the flameproofing test was carried out again. The flameproof effect had not changed.

We claim:

1. A process for the flameproofing of fiber material, which comprises applying (meth-)acrylic acid-alkyl-esters of the general formula

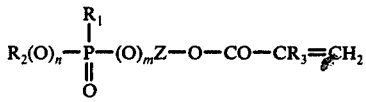

I, in which $n$ and $m$ and 0 or 1 and $(n+m)$ are 0 or 1, and $R_1$ stands for a saturated or unsaturated aliphatic hydrocarbon radical having from 1 to 8, preferably from 1 to 4 carbon atoms, which radical may also be substituted, preferably mono-substituted, by chlorine, bromine, the nitrile group, or the radicals $—OR_4$ or $—COOR_4$, $R_2$ has the same meaning as $R_1$ and if $n$ is 0 and $m$ is 1 may also be a group of the formula

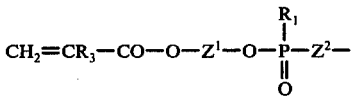

Ia or

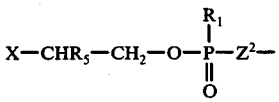

Ib,

Z, $Z^1$, $Z^2$ represent straight-chain or branched $(C_1-C_3)$-alkylene radicals which may also be substituted, preferably mono-substituted, by chlorine, bromine or the hydroxy group, X stands for a hydrogen, a chlorine or a bromine atom, a hydroxy or a methyl group, $R_3$ represents a hydrogen atom or a methyl group, and $R_4$ is a hydrogen atom or an alkyl group having from 1 to 8 carbon atoms, and $R_5$ is a hydrogen atom, the methyl or the chloromethyl group, onto the fiber material, the said (meth-)acrylic acid-alkyl-esters being dissolved in an inert solvent, and subjecting the latter substances to a polymerization by using radicals.

2. A process as claimed in claim 1 wherein a (meth-)acrylic acid-alkyl ester of the formula

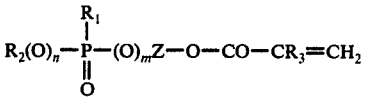

I, is used, in which $n$ and $m$ are 0 or 1 and $(n+m)$ are 0 or 1, and $R_1$ is saturated or unsaturated alkyl with 1 to 4 carbon atoms, $R_2$ has the same meaning as $R_1$ and —for $n = 0$ and $m = 1$—may also be a group of the formula

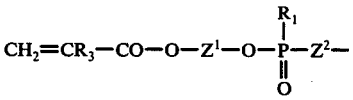

Ia or

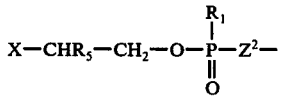

Ib,

Z, $Z^1$, $Z^2$ are straight-chain or branched $(C_1-C_3)$-alkylene which may be substituted, preferably mono-substituted, by chlorine, bromine or hydroxy, X is hydrogen, chlorine, bromine, hydroxy or methyl, $R_3$ is hydrogen or methyl, and $R_5$ is hydrogen, methyl or chloromethyl.

3. A process as claimed in claim 1 wherein the insert solvent is water.

4. A process as claimed in claim 1 which comprises effecting the polymerization by using radicals at a temperature in the range of from 80° to 180° C.

5. A process as claimed in claim 1 which comprises adding compounds having a cross-linking effect to the impregnation bath.

6. A process as claimed in claim 1 which comprises adding plastic dispersions to the impregnation baths.

* * * * *